US006059644A

United States Patent [19]

Manor et al.

[11] Patent Number: 6,059,644

[45] Date of Patent: May 9, 2000

[54] BACK-UP PAD FOR ABRASIVE ARTICLES AND METHOD OF MAKING

[75] Inventors: Edward L. Manor, Lakeland, Minn.; David C. Roeker, Hudson, Wis.

[73] Assignee: 3M Innovative Properties Company, St. Paul, Minn.

[21] Appl. No.: 09/195,299

[22] Filed: Nov. 18, 1998

[51] Int. Cl.[7] ..... B24D 17/00

[52] U.S. Cl. ..... 451/490; 451/360; 451/494; 451/353; 451/456

[58] Field of Search ..... 451/28, 41, 63, 451/344, 350, 351, 352, 353, 356, 357, 359, 360, 540, 548, 528, 488, 449, 494, 456, 490; 29/527.1, 527.4, 525.02, 525.03, 525.04

[56] References Cited

U.S. PATENT DOCUMENTS

| | | | |
|---|---|---|---|
| Re. 26,552 | 3/1969 | Block et al. . | |
| 3,638,362 | 2/1972 | Stoll . | |
| 3,673,744 | 7/1972 | Olmoen . | |
| 3,785,092 | 1/1974 | Hutchins . | |
| 3,824,745 | 7/1974 | Hutchins . | |
| 3,854,206 | 12/1974 | Hutchins . | |
| 3,862,521 | 1/1975 | Isaksson . | |
| 3,932,966 | 1/1976 | Stern | 451/359 |
| 3,935,678 | 2/1976 | Marton . | |
| 4,058,936 | 11/1977 | Marton | 451/359 |
| 4,062,152 | 12/1977 | Mehrer . | |
| 4,135,334 | 1/1979 | Rudiger . | |
| 4,145,848 | 3/1979 | Hutchins | 451/456 |
| 4,158,935 | 6/1979 | Robert . | |
| 4,184,291 | 1/1980 | Marton . | |
| 4,287,685 | 9/1981 | Marton . | |
| 4,531,329 | 7/1985 | Huber . | |
| 4,549,371 | 10/1985 | Hakoda . | |
| 4,616,449 | 10/1986 | Marton . | |
| 4,671,020 | 6/1987 | Hutchins . | |
| 4,680,895 | 7/1987 | Roestenberg . | |
| 4,759,155 | 7/1988 | Shaw . | |
| 4,779,385 | 10/1988 | Reiter . | |
| 4,844,967 | 7/1989 | Goralski et al. . | |
| 4,932,163 | 6/1990 | Chilton et al. . | |
| 4,964,245 | 10/1990 | Braasch . | |
| 5,105,585 | 4/1992 | Hampl et al. | 451/456 |
| 5,201,101 | 4/1993 | Rouser et al. . | |
| 5,231,738 | 8/1993 | Higashinaka . | |
| 5,283,988 | 2/1994 | Brown . | |
| 5,369,852 | 12/1994 | Higashinaka . | |
| 5,369,853 | 12/1994 | Okawa et al. . | |
| 5,423,716 | 6/1995 | Strasbaugh . | |
| 5,515,583 | 5/1996 | Higashinaka . | |
| 5,692,949 | 12/1997 | Scheffield et al. . | |
| 5,807,161 | 9/1998 | Manor et al. . | |

FOREIGN PATENT DOCUMENTS

| | | |
|---|---|---|
| 0 285 042 | 3/1988 | European Pat. Off. . |
| 41 24 520 A1 | 1/1993 | Germany . |
| 44 00 550 A1 | 7/1995 | Germany . |
| 94 14 167 | 2/1996 | Germany . |
| WO 95/19242 | 7/1995 | WIPO . |
| WO 97/20662 | 6/1997 | WIPO . |

OTHER PUBLICATIONS

Brochure entitled "Dustcontrol™" by Transmatic, Inc.
Brochure entitled "Dynorbital® Air–Powered Random Orbital Sander" by Dynabrade, Inc., pp. 2–6, 38, 52.
Brochure entitled "Clean Air™" by DCM Corp.
Brochure entitled "Merit Abrasives"by Dynorbital®.
Catalog entitled "Industrial Power Tools Accessories & Abrasives"by Dynabrade®.
Copy of Aug. 13, 1999 International Search Report from PCT/US99/03940.

*Primary Examiner*—Derris Holt Banks

[57] ABSTRACT

A back-up pad for pad for supporting an abrasive article. A preferred embodiment of the invention provides a back-up pad having a dust collection groove, in which the engagement component for securing the abrasive article is attached to the dust collection groove surface. The present invention also provides a method for forming a back-up pad with a dust collection groove

16 Claims, 4 Drawing Sheets

BACK-UP PAD FOR ABRASIVE ARTICLES AND METHOD OF MAKING

TECHNICAL FIELD

The present invention relates generally to a back-up pad for supporting an abrasive article and to methods of making such a back-up pad. The present invention relates more particularly to a back-up pad having a dust collection groove, in which the engagement component for securing the abrasive article is attached to the dust collection groove surface.

BACKGROUND OF THE INVENTION

Abrasive articles have long been used in industry for abrading, grinding, and polishing applications. They can be obtained in a variety of converted forms, such as belts, discs, sheets, and the like, in many different sizes.

Generally, when using abrasives articles in the form of "sheet goods", i.e. discs and sheets, a back-up pad is used to mount or attach the abrasive article to the abrading tool. Back-up pads are well known in the abrasive art and are described, for example, in U.S. Pat. No. 5,692,949 (Sheffield et al.) and PCT publication WO 97/20662 (Keipert), published on Jun. 12, 1997. Known back-up pads usually have one side on which an abrasive article, such as a disc, is attached. The other side of the back-up pad generally has a screw or other fastener extending therefrom to attach the back-up pad to a power tool.

Two common methods of attaching abrasive discs and sheets to back-up pads include pressure sensitive adhesives and hook and loop fasteners. When the attachment means is a hook and loop system, the abrasive article will have either loop or the hook component on the backing surface opposite the abrasive coating, and the back-up pad will have the complementary mating component, i.e., the hook loop. An example of abrasives with a hook and loop fastener is available from Minnesota Mining and Manufacturing of St. Paul, Minn. under the trade designation "Hookit" or "Hookit II." When the attachment means is a pressure sensitive adhesive, the abrasive article will generally have the adhesive thereon and the back-up pad will typically have a smooth surface such as vinyl or rubber. An example of abrasives with a pressure sensitive adhesive attachment means is available under the trade designation "Stikit" from Minnesota Mining and Manufacturing of St. Paul, Minn.

Back-up pads having dust collection grooves and dust collection holes are well known in the abrasive art and are described, for example, in U.S. Pat. No. 4,184,291, U.S. Pat. No. 4,779,385, and U.S. Pat. No. 4,759,155. Known back-up pads usually have dust collection grooves in the support surface of the back-up pad and include dust collection holes through the support surface which are in fluid communication with the dust collection grooves. The dust collection holes are typically connected to a vacuum source. The dust collection grooves and holes provide a passageway for removing dust, debris, or abrading fluid, such as water or oil, from the abrading surface.

Profile back-up pads are well known in the abrasive art. Known profile pads have contoured shaped support surfaces adapted to conform to the irregular surface of a work piece, such as wood trim or molding. However, such profile pads do not include dust holes or dust collection grooves for removing any dust, debris, or abrading fluid, such as water or oil, from the abrading surface.

In conventional back-up pads having dust grooves in their support surfaces, the engagement component attached to the support surface is two separate pieces. The first piece of the engagement component covers the central portion of the back-up pad up to the dust collection groove. The second piece of the engagement component covers the outer portion of the back-up pad extending between the dust collection groove and the outer edge of the back-up pad. When abrasive sheets are repeatedly attached and detached from the engagement component, the first piece and second piece of the conventional engagement component experience a high unit tension along the peripheral edges of the first piece and the second piece. The high unit stress is due to the force of detaching the abrasive sheet from the small area along the peripheral edges of the conventional engagement component. The high unit stress along the peripheral edges has a tendency to cause the first piece and second piece of the engagement component to delaminate from the support surface. Additionally, the conventional back-up pad includes sharp edges between the dust groove and the support surface because the dust groove is usually cut into the engagement component and support surface of the back-up pad after the backup-pad is formed. The sharp edges of the conventional engagement component also have a tendency to delaminate from the support surface of the back-up pad.

SUMMARY OF THE INVENTION

The present invention provides a method of making a back-up pad for supporting an abrasive article. The method includes the steps of: a) providing a support member including a first major surface, and a second major surface opposite the first major surface, where the first major surface includes a support surface and a dust collection groove, and where the dust collection groove includes a groove surface; and b) attaching an engagement component to the first major surface of the support member and to the groove surface. In one preferred embodiment of this method, the method further includes the step of c) forming a hole through the engagement component and the support member, where the hole is in fluid communication with the dust collection groove. In another preferred embodiment of this method step c) includes forming a first plurality of the holes through the engagement component and the support member, where the first plurality of the holes is in fluid communication with the dust collection groove.

In yet another preferred embodiment of the above method, the engagement component includes a plurality of loops adapted for releasable engagement with a plurality of hooks on an abrasive article. In another preferred embodiment of the above method, the engagement component includes a plurality of hooks adapted for releasable engagement with a plurality of loops on an abrasive article. In still another preferred embodiment of the above method, the engagement component includes a smooth surface adapted for releasable engagement with a layer of adhesive on an abrasive article. In another aspect of this embodiment, the smooth surface comprises vinyl. In another preferred embodiment of the above method, the engagement component includes a self-mating fastener adapted for releasable engagement with a like fastener on an abrasive article.

In yet another preferred embodiment, step a) comprises molding a moldable material to thereby provide the support member. In another aspect of this embodiment, step a) further comprises molding the dust collection groove in the first major surface of the support member. In another aspect of this embodiment, the steps a) and b) further comprise placing the engagement component in a mold and introducing the moldable material into the mold, whereupon solidification of the moldable material, the engagement component is thereby attached to the first major surface of the support member and to the groove surface. In another aspect of this embodiment, the mold includes an annular protrusion for forming the dust collection groove in the first major surface of the support member. In yet another aspect of this embodiment, the method further includes the step of imparting a groove in the engagement component prior to placing the engagement component in the mold, and where the groove in the engagement component corresponds to the dust collection groove in the first major surface of the support member.

In another preferred embodiment, the above method further includes the step of imparting the dust collection groove on the first major surface of the support member after molding a moldable material to provide the support member. In another preferred embodiment of the above method, a hole is at least partially molded through the support member. In yet another preferred embodiment, the moldable material comprises a resilient foam material. In another aspect of this embodiment, the resilient foam material comprises open cell polyurethane foam.

In another preferred embodiment, the above method further includes the step of placing a drive member in the mold prior to introducing the moldable material to thereby attach the drive member to the second major surface of the support surface. In another preferred embodiment, the above method further includes a step prior to step b) of: forming a groove in the engagement component corresponding to the dust collection groove in the first major surface of the support surface, where step b) further includes aligning the groove in the engagement component with the dust collection groove in the support surface.

In another preferred embodiment of the above method, the support member includes a drive member attached to the second major surface of the support member. In yet another preferred embodiment, the dust collection groove in the first major surface of the support member comprises an annulus. In another preferred embodiment of the above method, the first major surface of the support surface comprises a plurality of grooves. In still another embodiment of the above method, the groove in the engagement component is at least 0.15 cm in depth.

The present invention also provides a back-up pad for supporting an abrasive article. The back-up pad comprises: a) a support member including a first major surface, where the first major surface includes a support surface and a dust collection groove, and where the dust collection groove includes a groove surface; and b) an engagement component attached to the first major surface of the support member and to the groove surface.

In a preferred embodiment, the above back-up pad further includes a hole through the engagement component and the support member, where the hole is in fluid communication with the dust collection groove. In another preferred embodiment of the above back-up pad, the back-up pad is in combination with a motor drive source and a vacuum source, where the support surface includes a second major surface opposite the first major surface, where the back-up pad further includes a drive member attached to the second major surface of the support member, where the drive member on the second major surface of the support member is connected to the motor drive source, and where the hole is in fluid communication with the vacuum source.

In another preferred embodiment of the above back-up pad, the back-up pad further includes a plurality of the holes through the engagement component and the support member, where the plurality of the holes are in fluid communication with the dust collection groove.

In another preferred embodiment of the above back-up pad, the engagement component comprises a plurality of loops adapted for releasable engagement with a plurality of hooks on an abrasive article. In another preferred embodiment of the above back-up pad, the engagement component comprises a plurality of hooks adapted for releasable engagement with a plurality of loops on an abrasive article. In another preferred embodiment of the above back-up pad, the engagement component includes a self-mating fastener adapted for releasable engagement with a like fastener on an abrasive article. In another preferred embodiment of the above back-up pad, the first major surface of the engagement component comprises a smooth surface adapted for releasable engagement with a layer of adhesive on the abrasive article. In another aspect of this embodiment, the smooth surface comprises vinyl.

In another preferred embodiment of the above back-up pad, the support member comprises a moldable material. In another aspect of this embodiment, the moldable material comprises a resilient foam material. In another aspect of this embodiment, the resilient foam material comprises open cell polyurethane foam.

In another preferred embodiment of the above back-up pad, the support member further includes a second major surface opposite the first major surface, and where the back-up pad further includes a drive member attached to the second major surface of the support member. In yet another preferred embodiment of the above back-up pad, the dust collection groove in the support surface comprises an annulus. In another preferred embodiment of the above back-up pad, the support surface includes a plurality of the dust collection grooves each including a respective groove surface, and where the engagement component is attached to the plurality of groove surfaces. In still another preferred embodiment of the above back-up pad, the distance between the portion of the engagement component attached to the first major surface of the support member and the portion of the engagement component attached to the groove surface is at least 0.15 cm.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
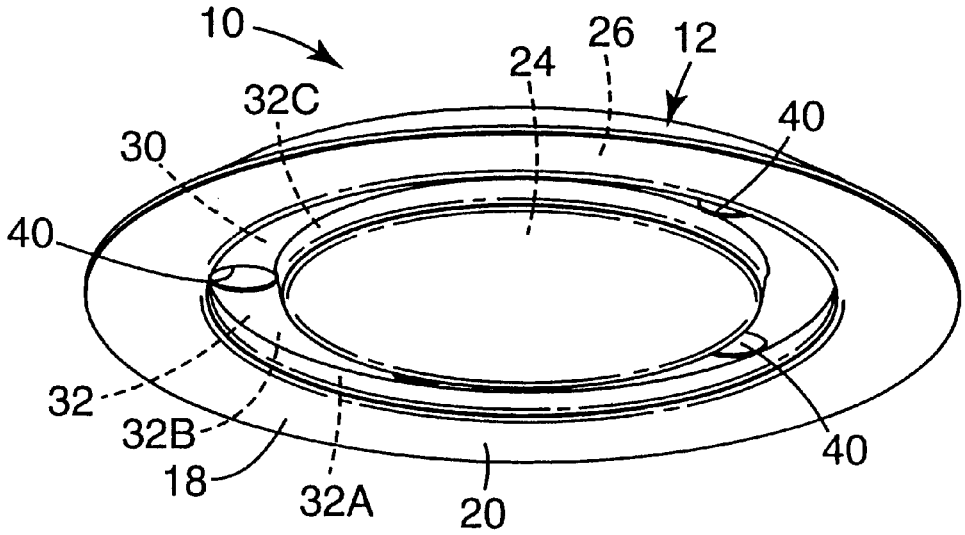
FIG. 1 is a front isometric view of a preferred embodiment of a back-up pad for supporting an abrasive article.

FIG. 1 illustrates one preferred embodiment of back-up pad 10 for supporting an abrasive article. The back-up pad includes a support member 12 and an engagement component 18 attached to the support member 12. The support member 12 includes a dust collection groove 30 between first and second surfaces 24, 26. The engagement component 18 is attached to the first and second surfaces 24, 26 and the dust collection groove 30 of the support member 12. The engagement component portions attached to the support surfaces 24, 26 provide areas for supporting an abrasive article. The abrasive article (not illustrated) attaches to the support surfaces 24, 26 and overlays the dust collection groove 30. Typically, the abrasive article remains generally flat against the engagement component portions attached to support surfaces 24, 26 in the support member 12, and does not conform to the contour of the dust collection groove 30.

Figure 2:
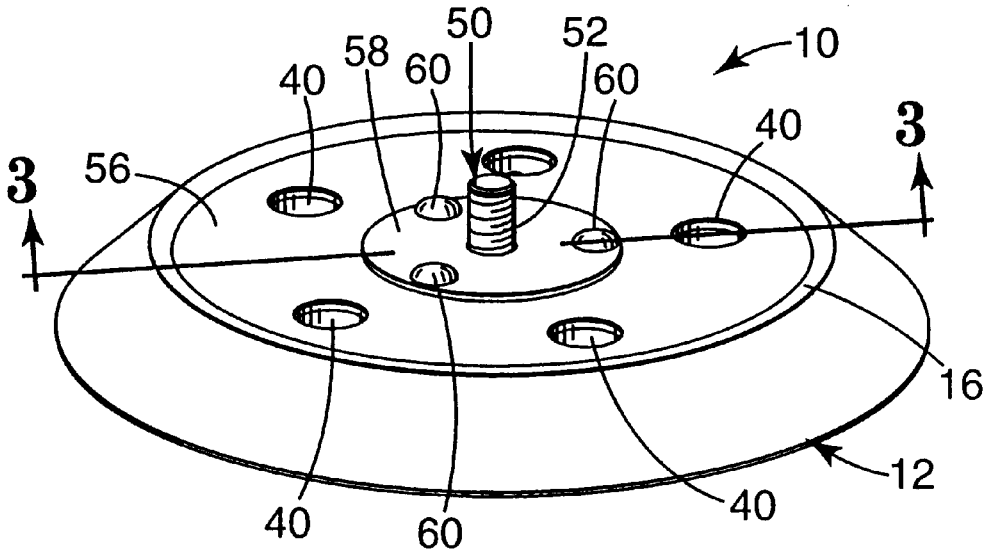
FIG. 2 is a rear isometric view of the back-up pad of FIG. 1.

FIG. 2 is a rear isometric view of the back-up pad 10 of FIG. 1. If back-up pad 10 is to be mounted on a power tool for rotation, the back-up pad 10 will include a drive member 50. For example, the second major surface 16 of support member 12 may include a threaded shaft 52 having a head retained to the back-up pad 10 by a retainer plate 56 mounted in the second major surface of the support member 12. For support, drive member may also include a support plate 58 around shaft 52 mounted to retainer plate 56 by a plurality of rivets 60 to provide additional rigidity to the support member 12. The threaded shaft 52 may engage with the output shaft of a machine to secure the back-up 10 to the machine for rotation. National Detroit D/A Sanders is an example of a power tools for use with the back-up pad 10. Other drive members 50 are also possible, including, but not limited to, an unthreaded shaft, multiple screws, or the like.

Figure 3:
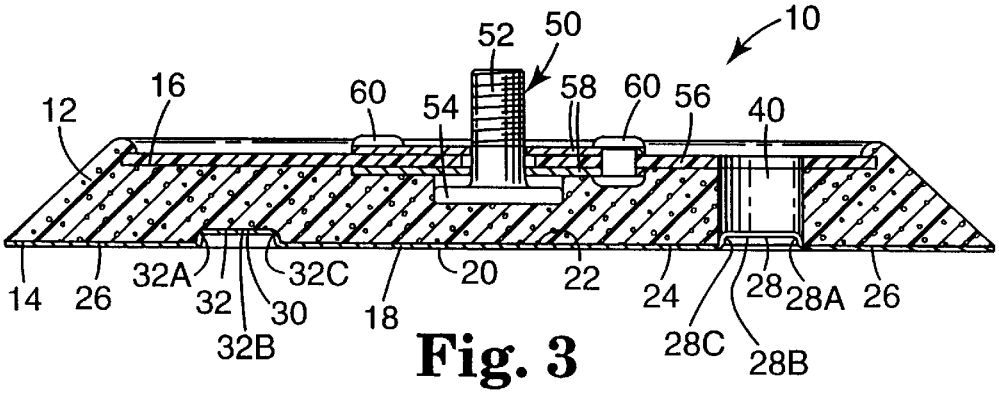
FIG. 3 is a cross-sectional view of the back-up pad taken along line 3—3 of FIG. 2.

FIG. 3 illustrates a cross-sectional view of back-up pad of FIG. 1. The support member 12 includes a first major surface 14 and a second major surface 16 located opposite the first major surface 14. The engagement component 18 includes a first major surface 20 and a second major surface 22 located opposite the first major surface 20. The second major surface 22 of the engagement component is attached to first major surface 14 of the support member, including first and second surfaces 24, 26 and dust groove 30.

As mentioned above, the first major surface 14 of the support member 12 includes a dust collection groove 30. The dust collection groove 30 includes a dust collection groove surface 32. In the preferred embodiment, the dust collection groove surface 32 is illustrated as having three continuous elements: two side surfaces 32A, 32C and a bottom surface 32B extending between the two side surfaces 32A, 32C. However, it is understood that the dust collection groove surface 32 could have one continuous surface without discrete portions. For example, the dust collection groove 30 could have a semi-circular in shape. While a preferred embodiment of dust collection groove has three surfaces 32A, 32B, 32A, it is understood that the dust collection groove 30 alternatively could have one, two, four or more surfaces.

The engagement component 18 is attached to the dust collection groove surface 32 of the dust collection groove 30. Preferably, the engagement component 18 is one continuous piece sized to attach to support surface 26, dust collection groove 30, and support surface 24. The engagement component 18 preferably is attached to support surfaces 24, 26, and extends into and is attached to dust collection groove surface 32. More preferably, the engagement component 18 conforms to the entire dust collection groove surface 32 and is continuous across the entire dust collection groove 30.

Figure 4:
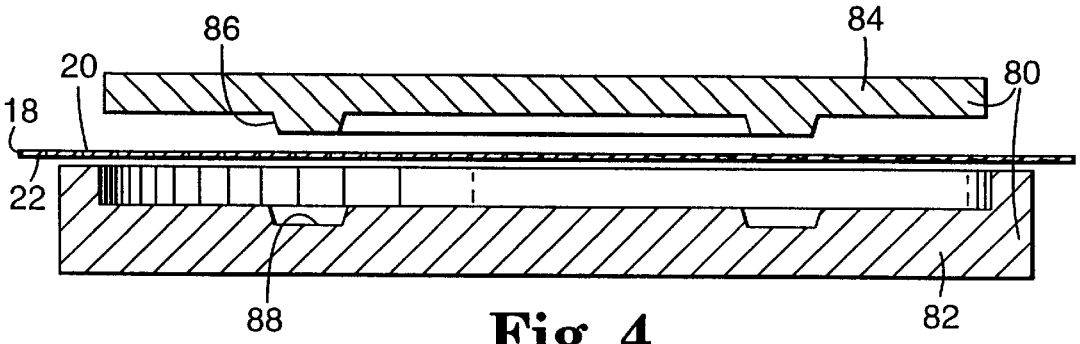
FIG. 4 is a cross-sectional view of a preferred press for imparting a dust collection groove in the engagement component prior to pressing the engagement component.
Figure 5:
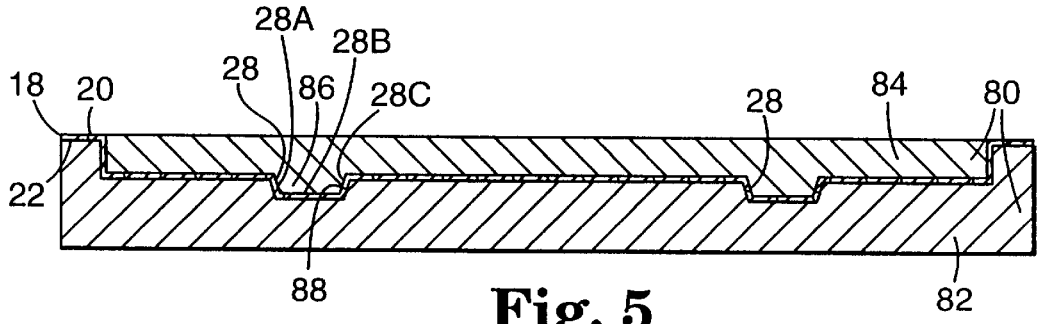
FIG. 5 is a cross-sectional view of the press of FIG. 4 closed thereby imparting a dust collection groove in the engagement component.

The engagement component 18 may be pre-shaped with a groove 28, which is similar to the dust collection groove 30 in support surface 12 (as illustrated in FIGS. 4–5), and then attached to support surface 12. In the preferred embodiment, the groove 28 in engagement component has three continuous elements: two side surfaces 28A, 28C and a bottom surface 28B extending between the two side surfaces 28A, 28C. Preferably, side surface 28A of the engagement component 16 attaches to side surface 32A of the groove 30 in support member 12. Preferably, bottom surface 28B of the engagement component 16 attaches to bottom surface 32B of the groove 30 in support member 12. Preferably, side surface 28C of the engagement component 16 attaches to side surface 32C of the groove 30 in support member 12.

The dust collection groove 30 and groove 28 in engagement component 18 are illustrated in the form of an annulus, however this is not necessary. For example, the dust collection groove 30 may be in the form of other shapes, for example, squares, triangles, rectangles and ellipses. Also, dust collection groove 30 may be in the form of a line or curve with two ends, rather than a closed shape. The dust collection groove 30 preferably has rounded or curved transitions between surfaces 32A, 32B, and 32C, and at the transition from the groove to the support surfaces 24, 26, however this is not necessary. Preferably, the dust collection groove 30 in the first major surface 14 of the support member 12 is at least 0.15 cm deep relative to the support surfaces 24, 26. Preferably, the distance between the portion of the engagement component 18 attached to the first major surface 14 of support member 12 and the portion of the engagement component 18 attached to the dust collection groove surface 32 is at least 0.15 cm.

The first major surface 14 of the engagement component 18 may comprise any material suitable for releasably attaching an abrasive article to the back-up pad 10. In one preferred embodiment, the first major surface 14 includes a plurality of loops adapted for releasable engagement with a plurality of hooks on an abrasive article. Examples of loops include stitched loops, brushed loops, formed loops, tricot loops, and the like. Commercially available loops useful for the present invention for releasably engaging hook-backed abrasives include various loops available form manufacturers such Kanebo Belltouch Ltd. of Osaka, Japan; Guilford Mills of Greensboro, N.J.; Woodeaves, Ltd. of Lancaster, England; and Minnesota Mining and Manufacturing, St. Paul, Minn. One preferred type of loops is disclosed in commonly assigned U.S. Pat. No. 5,692,949 (Sheffield et al.), issued on Dec. 2, 1997, the entire disclosure of which is incorporated herein by reference. One example of an abrasive article for use with the plurality of loops on back-up pad 10 is the "Hookit II" brand abrasive sheets commercially available from Minnesota Mining and Manufacturing of St. Paul, Minn.

In another preferred embodiment, the first major surface 14 of the engagement component 18 includes a plurality of hooks adapted for releasable engagement with a plurality of loops on an abrasive article. Examples of hooks include mushroom-shaped hooks, "J" hooks, stalks, and "T" hooks. Commercially available hooks useful for the present invention for releasably engaging loop-backed abrasives include various hooks available from manufacturers such as Kanebo Belltouch Ltd. of Osaka, Japan; Velcro Inc. of Manchester, N. H.; and Minnesota Mining and Manufacturing of St. Paul, Minn. One example of an abrasive article for use with the plurality of hooks on back-up pad 10 is the "Hookit" brand abrasive sheets commercially available from Minnesota Mining and Manufacturing of St. Paul, Minn. The first major surface 14 of the engagement component 18 may also include a self mating fastener adapted to releasably engage the same self mating fastener on the abrasive sheet. One example of such self-mating fasteners are commercially available under the trade designation of "Dual Lock" from Minnesota Mining and Manufacturing of St. Paul, Minn. Another example of self-mating fasteners is disclosed in Rouser et al. (U.S. Pat. No. 5,201,101.)

In another preferred embodiment, the first major surface 14 of the engagement component 18 includes a smooth surface adapted for releasable engagement with a layer of adhesive on an abrasive article. For instance, the smooth surface could be a smooth, non-porous surface, such as vinyl, rubber, or metal, although other surfaces are also suitable. A preferable type of vinyl is commercially available under the trade name "74412 Buffer Cover Material" from Uniroyal of Mishawaka, Ind. Alternatively, the smooth surface comprises cloth. A preferable type of cloth includes cotton duck cloth commercially available from Milliken & Co. of Spartenburg, S.C.

The abrasive article for use with the back-up pad 10 having smooth surface typically includes a pre-coated layer of adhesive on the side opposite the abrasive coating. One example of an abrasive article for use with the smooth surface of back-up pad 10 is the "Stikit" abrasive sheets from Minnesota Mining and Manufacturing of St. Paul, Minn. Another example of an adhesive article includes the use of an adhesive commonly known as a "feathering disc adhesive." The abrasive article initially has no adhesive, e.g., pressure sensitive adhesive, thereon. The feathering disc adhesive is applied onto either the abrasive article backing or the first major surface 20 of the engagement component 18, or both. The abrasive article is then attached to the smooth surface of the back-up pad 10. After using the abrasive article, the article is removed from the back-up pad, and another abrasive article is attached to the back-up pad 10 with or without adding additional feathering disc adhesive. The first major surface 20 of engagement component 18 are preferable cloth surfaces in some feathering disc applications. Examples of adhesives suitable for both a pressure sensitive adhesives or a feathering disc adhesive include latex crepe, rosin, acrylic polymers and copolymers (e.g., polybutylacrylate), polyacrylate ester, vinyl ethers (e.g., polyvinyl n-butyl ether), vinyl acetate adhesives, alkyd adhesives, rubber adhesives (e.g., natural rubber, synthetic rubber, chlorinated rubber), and mixtures thereof. One preferred pressure sensitive adhesive is an isooctylacrylate acrylic acid copolymer.

In another preferred embodiment, the first major surface 14 of the engagement component 18 includes a plurality of both hooks and loops adapted for releasable engagement with a similar plurality of hooks and loops on an abrasive article. Alternatively, such an engagement component 18 could releasably engage with a plurality of hooks on an abrasive article or with a plurality of loops on an abrasive article. An example of such a plurality of both hooks and loops in the fastener is disclosed in Okawa et al. (U.S. Pat. No. 5,369,853).

Figure 7:
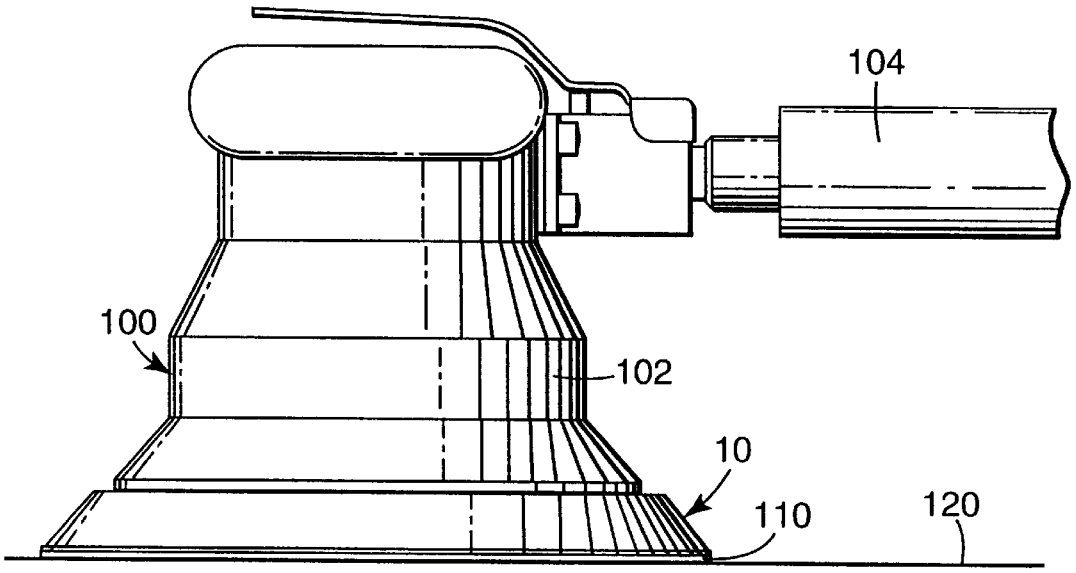
FIG. 7 is a side view of a vacuum source and drive means for use with the back-up pad of FIG. 1.

The back-up pad 10 is illustrated in FIG. 3 as including a plurality of holes 40, however this is not essential. Back-up pad 10 may include only one hole 40. The holes 40 provide a passageway for removing dust, debris, or abrading fluid, such as water or oil, from the abrading surface. The holes 40 are typically connected to a vacuum source, as illustrated in FIG. 7, which removes dust and debris from the abraded surface. Holes 40 are in fluid communication with the dust collection groove 30. Preferably, holes 40 extend through the engagement component 18 and support member 12. More preferably, holes 40 extend from the first major surface 20 of the engagement component 18 to the second major surface 16 of support member 14. Preferably, holes 40 continue through retainer plate 56 mounted on the second major surface 16 of the support member 12. More preferably, support plate 50 does not interfere with holes 40 in the support member 12 so to allow dust to flow through the holes 40 while the back-up pad 10 is in use.

In many previous back-up pads, an abrasive article is attached to the conventional back-up pad by aligning holes in the abrasive article with the dust collection holes in the back-up pad. This allows the dust and debris from the abraded surface to be vacuumed up through the aligned holes. In the present invention, it is not necessary to align the holes in the abrasive article to the holes 40 in the back-up pad 10 for attachment to the back-up pad 10. All that is required is to align the holes in an abrasive article with the dust collection groove 30 in the back-up pad 10. When the abrasive article and back-up pad 10 are properly aligned, the dust collection groove 30 in support member 12 is in fluid communication with the holes 40 in the back-up pad. Thus, the dust and debris may then flow through the holes in the abrasive article, into dust collection groove 30 and into holes 40 through the back-up pad 10. Preferably, a vacuum source is used with back-up pad 10 as shown in FIG. 7 for sucking the dust and debris from holes 40 in the back-up pad 10.

As illustrated in FIG. 3, the engagement component 18 of the present invention conforms to the entire dust collection groove surface 32 in support member 12 and is continuous across the entire dust collection groove 30. If the engagement component 18 conforms to the entire dust collection groove surface 32, there is a stronger bond between the engagement component 18 and the first major surface 14 of the support member 12 as compared to the bond between the engagement component and support member of the conventional back-up pad described above. The bond is stronger because the unit tension from the stress of detaching the abrasive sheet is distributed over a larger area than that of prior back-up pads. Attaching the engagement component 18 to the dust collection groove surface 32 of dust collection groove 30 minimizes the tendency for the engagement component 18 to delaminate from the support surface 12 of the back-up pad 10. Additionally, if the engagement component 18 is continuous across the dust collection groove surface 32, the edges of the dust collection groove 30 have a tendency to be rounded in contrast to the sharp edges of the groove in the conventional back-up pad described in the background. Also, the attachment component does not have any free edges, except at the under periphery of the back-up pad.

The engagement component 18 may be attached to the support surface 12 and the dust collection groove 30 in a variety of ways. For instance, the dust collection groove 30 may be first imparted on the first major surface 14 of the support member 12 and then the engagement component 18 may be attached to the support surface 12 and dust collection groove 30, for example, by adhesive. Methods of imparting the dust collection groove 30 on the support surface 12 include cutting, molding, or forming the dust collection groove 30 into the first major surface by any other way known to those skilled in the art. Alternatively, the dust collection groove 30 is first pre-shaped by imparting a groove 28 in the engagement component 18. Methods of imparting the groove 28 in the engagement component 18 include cold pressing, vacuum forming, or thermo forming. The groove 28 in the engagement component 18 corresponds to the dust collection groove 30 imparted on the first major surface 14 of the support member 12. Then the groove 28 in engagement component 18 is aligned with and attached to the dust collection groove 30 in support surface 12 to form back-up pad 10, for example, by adhesive. Alternatively, the groove 28 is preformed or imparted in the engagement component and then the support surface 12 is molded to the second major surface 16 of the engagement component 18 to form back-up pad 10 with a dust collection groove 30.

Figure 6:
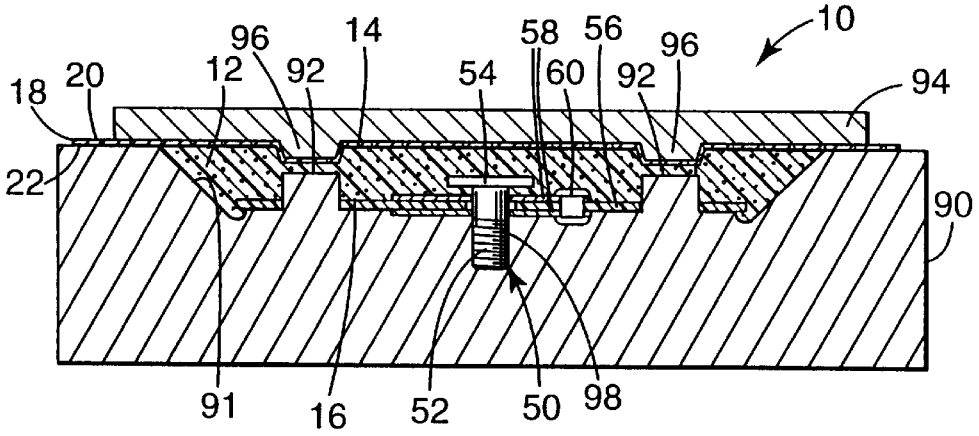
FIG. 6 is a cross-sectional view of a preferred mold used to make the back-up pad of FIG. 1.

One preferred method of making the back-up pad 10 is illustrated in FIGS. 4–6. FIGS. 4–5 illustrate a preferred method of forming the groove 28 in the engagement component 18. Preferably, the engagement component 18 is first heated such as by being placed between two heated platens (not illustrated) and then placed into a cold forming press 80. The press 80 illustrated includes a male portion 84 having an annular protrusion 86 and includes a corresponding female portion 82 having an annular groove 88. The first major surface 20 of the engagement component 18 faces the male portion 84 of the press 80. The second major surface 22 of the engagement component 18 faces the female portion 82 of the press 80. FIG. 4 illustrates the press in an open position. FIG. 5 illustrates the press in the closed position. When the press 80 is in the closed position and the preheated engagement component 18 is allowed to cool, protrusion 86 forms the groove 28 in engagement component 18. The groove 28 includes two side surfaces 28A, 28C and a bottom surface 28B extending between side surfaces 28A, 28C. Preferably, the depth of the groove 28 in engagement component 18 is at least 0.15 cm. The groove 28 is open to the first major surface 20 of the engagement component 18. Alternatively, groove 28 in the engagement component 18 may be preformed or imparted in engagement component 18 by vacuum forming.

After the groove 28 is formed in the engagement component 18, a mold 90 is used to form the support member 12 to the engagement component 18 thereby providing the back-up pad 10 with the dust collection groove 30. As seen in FIG. 6, the mold 90 includes a cavity 91 shaped to form the back-up pad 10. Preferably, the mold 90 also includes a portion 98 for positioning the drive member 50 in the bottom of the mold 90. Additionally, mold 90 includes posts 92 for partially forming holes 40 through the back-up pad 10 up to the engagement component 18. The mold includes a lid 94 with an annular protrusion 96 corresponding to the groove 28 in the engagement component. The male portion 84 of the press 80 may serve as a lid 94 for the mold 90. After the drive member 50 is placed in the portion 98 of the mold 90, a moldable material is introduced into the cavity 91 of the mold 90. Preferably, the moldable material is a resilient foam material. More preferably, the moldable material is open cell polyurethane foam. After pouring the moldable material into the mold, the engagement component 18 is placed along the top portion of the mold 90 between the lid 94 and the mold 90. The second major surface 22 of the engagement component 18 faces the moldable material and the first major surface 20 faces the lid 94 for the mold 90. The annular protrusion 86 in the lid 94 helps maintains the shape of the groove 28 in the engagement component 18 as the moldable material bonds to the second major surface 22 of the engagement component 18. The moldable material forms the support member 12 of the back-up pad 10 including dust collection groove 30.

The support member 12 of the back-up pad 10 is preferably a resilient material such as a flexible foam, for example, polyurethane, polyester, polyester-urethane, polyetherurethane, a natural or artificial rubber such as a polybutadiene, polyisoprene, EPDM polymer, polyvinylchloride (PVC), polychroloprene, or styrene/butadiene copolymer. The foam can be open or closed cell. Additives, such as coupling agents, toughening agents, curing agents, antioxidants, reinforcing materials, and the like can be added to the foam formulation to achieve the desired characteristics. Dyes, pigments, fillers, anti-static agents, fire retardants, and scrim can also be added to the foam.

One preferred moldable material is disclosed in PCT publication WO 97/20662, Keipert, published on Jun. 12, 1997, the entire disclosure of which is incorporated herein by reference. Keipert discloses an abrasive article back up pad having resilient, open cell polyurethane foam formed as the reaction product of a polyether polyol and an aromatic polyisocyanate, such as an aromatic polyisocyanate including methylene diphenyl diisocyanate.

After the moldable material sufficiently solidifies, the back-up pad 10 may be removed from the mold 90. Final finishing steps are then completed to form the back-up pad 10. The outer diameter of the engagement component 18 is trimmed to conform to the first major surface 14 of the support member 12. The molded partial holes 40 are punched to form holes 40 extending from the engagement component 18 to the second major surface 16 of the support member 12. It is preferred to partially mold holes 40 first and then punch the holes 40 through completely. The advantage of first partially molded holes 40 is to discourage foam deformation when cutting the holes 40 and to provide a molded skin on the interior of the holes 40, for preventing dust and debris from collecting in foam cells, which is undesirable.

FIG. 7 illustrates back-up pad 10 attached to a power tool and vacuum source 100. One example of a suitable power tool is a vacuum sander commercially available from National Detroit, Inc. located in Rockford, Ill. The vacuum source includes a vacuum housing 102 and conduit 104. The vacuum source is in fluid communication with the holes 40 in the back-up pad 10. An abrasive article 110 is attached to the support surfaces 22, 24 of the back-up pad 10 for abrading a workpiece 120. The abrasive article 110 includes holes (not illustrated) aligned with the dust collection groove 30 in the back-up pad 10. The dust and debris from the workpiece 120 is sucked first through the holes in the abrasive sheet, into the dust collection groove 30, through holes 40, into the vacuum housing 100 and into the vacuum conduit for eventual disposal.

Figure 8:
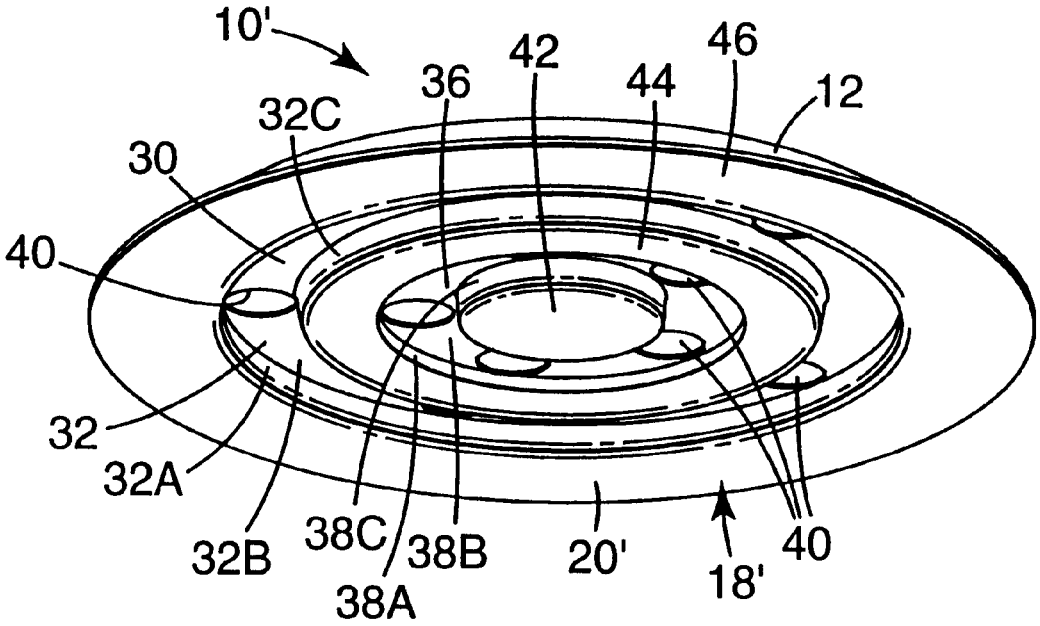
FIG. 8 is an isometric view of an alternative back-up pad including a plurality of dust collection grooves.

FIG. 8 illustrates an alternative back-up pad 10' including a plurality of dust collection grooves 30. The back-up pad 10' is illustrated as including two concentric dust collection grooves 30. The back-up pad 10' includes a first support surface 42 in the center of the back-up pad 10', a second support surface 44 located between the two dust collection grooves, and a third support surface 46 located at the outer perimeter of the back-up pad 10'. However, back-up pad 10' may include more than two dust collection grooves 30 and more or less number of support surfaces. However, the back-up pad 10' preferably includes enough support surfaces to adequately support an abrasive article. Alternatively, the plurality of dust collection grooves 30 may be in the form of spirals or other forms mentioned above. Preferably, the engagement component 18 is attached similarly to the support surfaces and dust collection grooves as mentioned above.

The operation of the present invention will be further described with regard to the following detailed examples. These examples are offered to further illustrate the various specific and preferred embodiments and techniques. It should be understood, however, that many variations and modifications might be made while remaining within the scope of the present invention.

One example method for performing the groove in the engagement component facing included putting the engagement component between two silicone-coated release papers in a heated platen press (model # N-800) manufactured by Hix Corporation (of Pittsburg, Kans.). The temperature of the heated platen press was raised to 275° F. for vinyl, 325° F. for 3M Hookit II, and 300° F. for Velcro facing material. The pressure was set at 207 KPa (30 psi) and the time was set for 30 seconds. Immediately after heating, the facing material was placed in a press similar to that illustrated in FIGS. 4–5 consisting of a male portion and a matching female portion, and then pressed into shape at a pressure of 689 KPa (100 psi) by a press as described in U.S. Pat. No. 4,569,431, the entire disclosure of which is incorporated herein by reference. The engagement component was allowed to cool in the press for 10–15 seconds.

One example of a method for forming the back-up pad of the present invention included forming the foam body in situ within an aluminum mold by using a suitable two-component water blown urethane foam formulation. The foam precursors consisted of a polyether polyol, water, and additives as the A-stream, and an isocyanate as the B-stream. These two streams were metered in the desired ratio, and mixed using a foam machine. Conventional foam machines useful for this method of backup pad manufacture generally come in two varieties. The first type is a "low pressure" machine which relies on a mechanical mixing device in the dispensing head to mix two component streams, which when mixed, react to create the foam. A second type of foam machine is a "high pressure" or impingement mixing machine. In this type of device, mixing is achieved by impingement of two high velocity component streams within the mixing chamber. Methods of using such foam machines are known in the art. For the present invention, a low pressure foam machine manufactured by the Edge-Sweets Company (Grand Rapids, Mich.) was used.

An aluminum mold and an aluminum mold lid (see FIG. 6) were used to make a five-inch diameter backup pad. A cardboard insert was inserted in the recessed portions of the lid. This improved the crispness of the corner of the groove in the finished pad by allowing for springback during the facing molding operation. The mold and lid were preheated to the desired cure temperature at 150° F. and the mold was coated with a mold release wax. The drive means hardware was inserted into the mold, and the desired weight of mixed foam precursors dispensed into the open mold. A pre-formed engagement component mentioned above was applied to the patterned surface of the mold lid such that the first major surface of the engagement component faced the mold lid. The lid was then placed on the mold containing the expanding foam mixture. The mold assembly was inserted into a pneumatic press and clamped with sufficient pressure to restrain the lid and maintain internal mold pressure at 365 KPa (53 psi). After 5 minutes had elapsed for the foam to rise and cure, the mold was unclamped and the back-pad ejected. The cooled facing material held the shape and was then molded into a pad as described above. The pad was trimmed and holes were cut through the facing material. The excess facing around the periphery of the pad and covering the dust collection holes was removed.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A back-up pad for supporting an abrasive article, comprising:

a) a support member including a first major surface, wherein said first major surface includes a support surface and a dust collection groove, and wherein said dust collection groove includes a groove surface; and b) an engagement component attached to said first major surface of said support member and to said groove surface such that said engagement component extends into said groove.

2. The back-up pad of claim 1, further including a hole through said engagement component and said support member, wherein said hole is in fluid communication with said dust collection groove.

3. The back-up pad of claim 2 in combination with a motor drive source and a vacuum source, wherein said support surface includes a second major surface opposite said first major surface, wherein said back-up pad further includes a drive member attached to said second major surface of said support member, wherein said drive member on said second major surface of said support member is connected to said motor drive source, and wherein said hole is in fluid communication with said vacuum source.

4. The back-up pad of claim 2, further including a plurality of said holes through said engagement component and said support member, wherein said plurality of said holes are in fluid communication with said dust collection groove.

5. The back-up pad of claim 1, wherein said engagement component comprises a plurality of loops adapted for releasable engagement with a plurality of hooks on an abrasive article.

6. The back-up pad of claim 1, wherein said engagement component comprises a plurality of hooks adapted for releasable engagement with a plurality of loops on an abrasive article.

7. The back-up pad of claim 1, wherein said engagement component comprises a self mating fastener adapted for releasable engagement with a like fastener on an abrasive article.

8. The back-up pad of claim 1, wherein said first major surface of said engagement component comprises a smooth surface adapted for releasable engagement with a layer of adhesive on said abrasive article.

9. The back-up of claim 8, wherein said smooth surface comprises vinyl.

10. The back-up pad of claim 1, wherein said support member comprises a moldable material.

11. The back-up pad of claim 10, wherein said moldable material comprises a resilient foam material.

12. The back-up pad of claim 11, wherein said resilient foam material comprises a open cell polyurethane foam.

13. The back-up pad of claim 1, wherein said support member further includes a second major surface opposite said first major surface, and wherein said back-up pad further includes a drive member attached to said second major surface of said support member.

14. The back-up pad of claim 1, wherein said dust collection groove in said support surface comprises an annulus.

15. The back-up pad of claim 1, wherein said support surface includes a plurality of said dust collection grooves each including a respective groove surface, and wherein said engagement component is attached to said plurality of groove surfaces.

16. The back-up pad of claim 1, wherein the distance between the portion of said engagement component attached to said first major surface of said support member and the portion of said engagement component attached to said groove surface is at least 0.15 cm.

* * * * *